US006674223B2

(12) United States Patent
Kim

(10) Patent No.: US 6,674,223 B2
(45) Date of Patent: Jan. 6, 2004

(54) MASK IN COLOR CATHODE RAY TUBE

(75) Inventor: Byoung Nam Kim, Taejon-shi (KR)

(73) Assignee: LG Electronics Inc., Seoul (KR)

( * ) Notice: Subject to any disclaimer, the term of this patent is extended or adjusted under 35 U.S.C. 154(b) by 192 days.

(21) Appl. No.: 09/725,481

(22) Filed: Nov. 30, 2000

(65) Prior Publication Data

US 2001/0007406 A1 Jul. 12, 2001

(30) Foreign Application Priority Data

Nov. 30, 1999 (KR) ..... 1999-53949

(51) Int. Cl.[7] ..... H01J 29/80
(52) U.S. Cl. ..... 313/402; 313/403; 313/408
(58) Field of Search ..... 313/402, 403, 313/407, 408

(56) References Cited

U.S. PATENT DOCUMENTS 3,883,770 A * 5/1975 Yamada et al. ..... 313/403
5,309,059 A * 5/1994 Kume et al. ..... 313/402
5,523,647 A * 6/1996 Kawamura et al. ..... 313/407
5,830,373 A * 11/1998 Ohtake et al. ..... 216/12

* cited by examiner

*Primary Examiner*—Nimeshkumar D. Patel
*Assistant Examiner*—Jason Phinney
(74) *Attorney, Agent, or Firm*—Birch, Stewart, Kolasch & Birch, LLP

(57) ABSTRACT

Mask in a color cathode ray tube, including electron beam pass through holes with bridges connected to non-hole portions between the beam pass through holes in a width direction, wherein a thickness of the bridge of the mask facing an electron gun is formed thinner than other portions of the mask, thereby attenuating howling and enhancing luminance.

11 Claims, 4 Drawing Sheets

MASK IN COLOR CATHODE RAY TUBE

BACKGROUND OF THE INVENTION

1. Field of the Invention

The present invention relates to a color cathode ray tube, and more particularly, to a mask in a color cathode ray tube for selecting colors of electron beams.

2. Background of the Invention

Of the color cathode ray tubes currently available, related art flat cathode ray tubes are spreading widely. These will be explained briefly.

Referring to FIG. 1, the related art flat color cathode ray tube is provided with a flat panel 1 of glass, and a funnel 3 in a form of a bulb welded to a back surface of the panel 1 by using Frit glass, to form an enclosure, with an inside space at a $10^{-7}$ Torr high vacuum. There is a safety glass 5 attached to a front surface of the panel 1 by using resin for prevention of explosion of the cathode ray tube, and R, G, B fluorescent film 2 coated on an effective area of a back surface of the panel 1 in a fixed pattern. There is a rail assembly 7 of rectangular metal frame bonded to a non-effective area of the panel 1 by using Frit glass, and a mask 11 welded to the rail assembly 7 having a fine beam pass through holes 10 of slit or crevice form at fixed intervals for selective passing of the R, G, B electron beams 9. There is an electron gun 13 sealed in a bottle-neck formed neck portion 4 in a rear portion of the funnel 3 for emission of electron beams 9, and a yoke 15 on an outer circumference of the neck portion 4 for forming vertical and horizontal magnetic fields to deflect and direct the electron beams 9 to an entire surface of the panel 1.

When power is provided to the foregoing flat cathode ray tube through a plurality of stem pins 16 at a rear portion thereof, thermal electrons(electron beams) are emitted from the cathodes as a heater in the electron gun 13 is heated, controlled, accelerated and focused as the electron beams 9 pass through a plurality of electrodes in the electron gun 9 in succession, subjected to color selection as the electron beams 9 pass through the mask 11 on an electron beam travel path, and collides onto the fluorescent film 2 coated on an inside surface of the panel 1. A picture is formed as the electron beams 9 are deflected by the yoke 15 on the outer circumference of the neck portion 4 to the screen area.

In the meantime, referring to FIGS. 2 and 3, only 20–25% of the electron beams 9 from the electron gun 13 pass through the beam pass through hole 10 in the mask 11, while approx. 75–80% is cut off at the non-hole portion 12. The electron beams 9 cut off at the mask 11 are converted into thermal energy, to expand the mask 11 by the thermal energy, thereby causing doming in which the path of the electron beams incident to the screen is changed, to thereby deteriorate color purity. Consequently, to prevent the doming of the mask 11, a tension mask is employed, wherein the tension mask is strained before it is fixed to the rail assembly 7 so that the tension mask can counteract the thermal expansion. In order to strain the tension mask, it is not only required to have an appropriate material property, but also an appropriate thickness, which is in a range of 25~80 $\mu$m. However, even if the mask 11 has a thickness within the above range, it is required to be subjected to rolling 1 or 2 times for flattening, which delays fabrication and pushes up costs. The mask 11 is liable to plastic deformation, such as crumpling, bending, tearing off, or other damage, which deteriorate productivity. For fear of deformation, the mask 11 cannot be subjected to a washing process for removing foreign matter stuck to it, which causes foreign matter to lodge in the beam pass through holes 10. Another problem of occurrence of howling in which the picture looks wavy as the electron beams collide, and the color on the screen is abnormal owing to vibration of the mask 11 that is caused by even a small external impact. As a solution for this, the thickness of the mask 11 is designed to be approximately 80 $\mu$m (an allowable maximum range of tension thickness) as shown in FIG. 3. However, the above solution causes other problems. Particularly, the thicker mask 11 also forms a thicker wall of the beam pass through hole 10, that deteriorates transmissivity of the electron beams 9. That is, as shown in FIGS. 4 and 5, if the two masks 11 are compared to be $t_1<T_1$, wall tapers of the beam pass through holes 10 are also compared to be $t_2<T_2$, and, accordingly, bridge areas formed between each beam pass through holes 10 in a width direction are also compared to be $s_3<S_3$. Consequently, the increased bridge surface increases a cut off amount of the electron beams 9, that reduces the transmissivity of the electron beams, and deteriorates luminance.

SUMMARY OF THE INVENTION

Accordingly, the present invention is directed to a mask in a color cathode ray tube that substantially obviates one or more of the problems due to limitations and disadvantages of the related art.

An object of the present invention is to provide a mask in a color cathode ray tube, in which a structure of the mask is improved for reducing howling and doming and improving luminance.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the mask in a color cathode ray tube, including electron beam pass through holes with bridges connected to non-hole portions between the beam pass through holes in a width direction, wherein a thickness of the bridge of the mask facing an electron gun is formed thinner than other portions of the mask, thereby attenuating howling and enhancing luminance.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
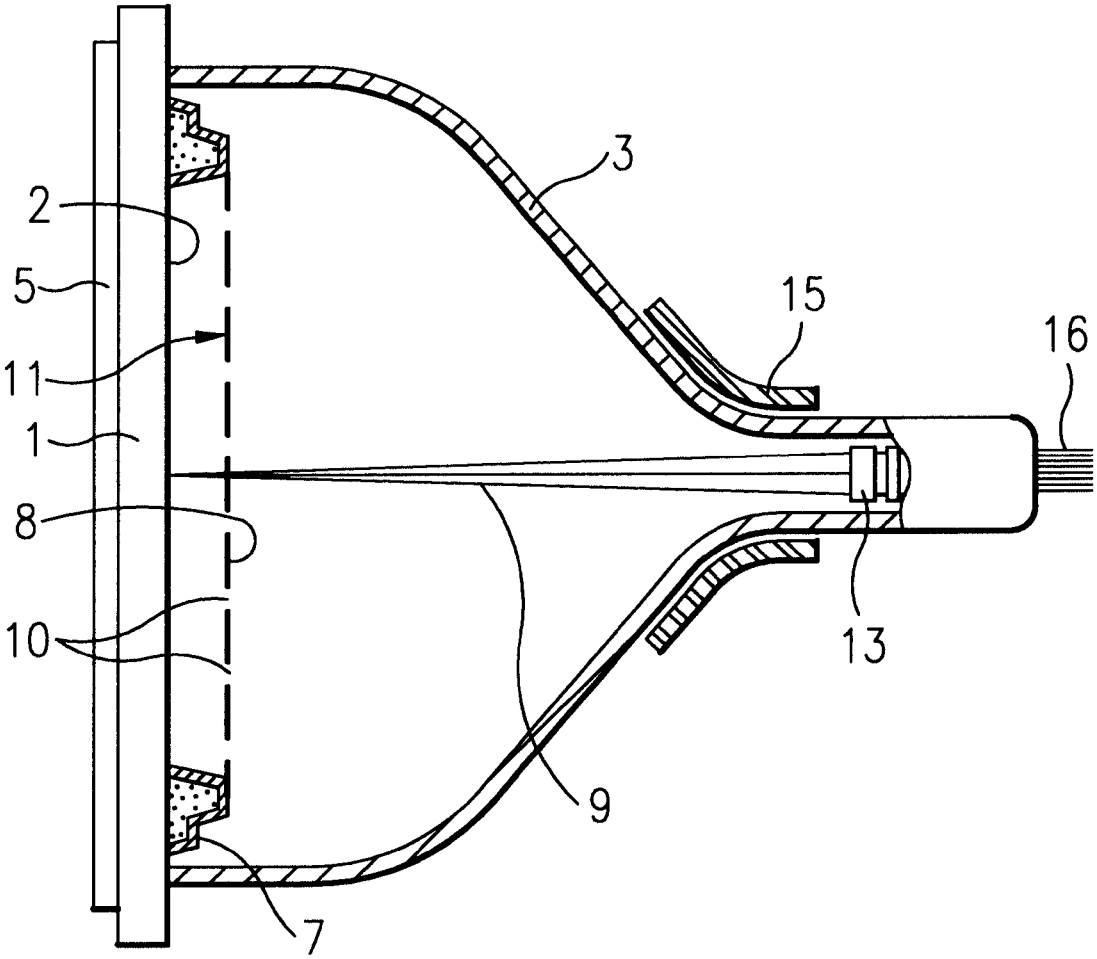
FIG. 1 Related Art
FIG. 1 illustrates a longitudinal section of a related art flat cathode ray tube.
Figure 2:
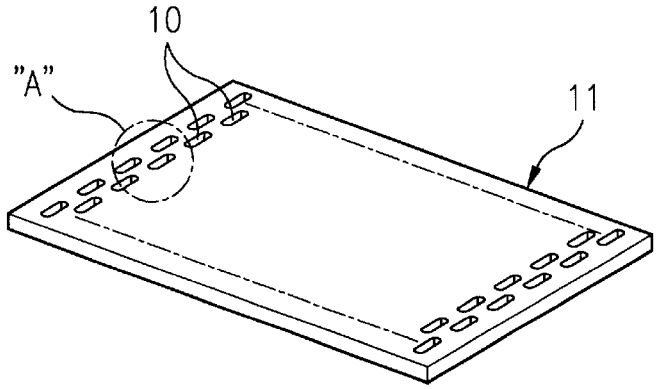
FIG. 2 Related Art
FIG. 2 illustrates a perspective view of a related art mask.
Figure 3:
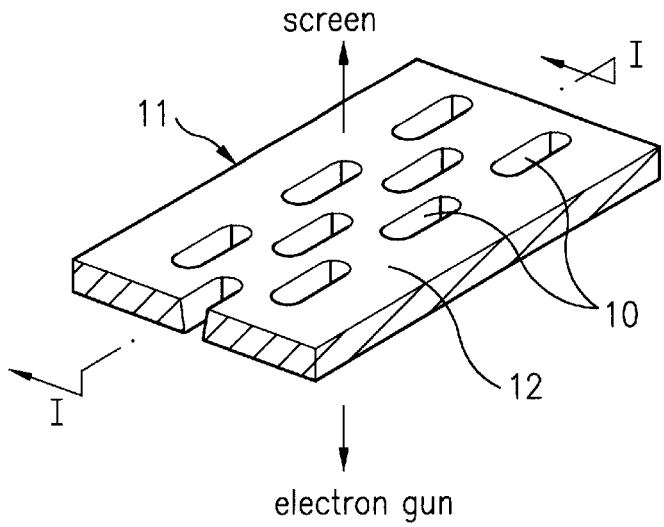
FIG. 3 Related Art
FIG. 3 illustrates an enlarged view of 'A' part in FIG. 2.
Figure 4:
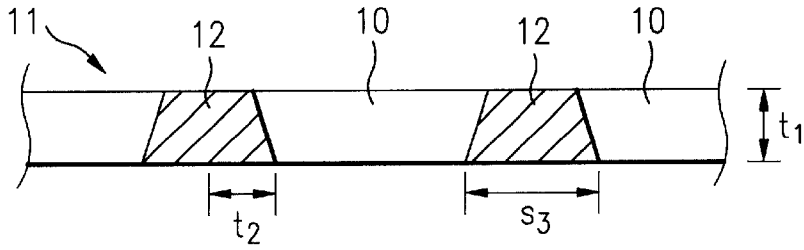
FIG. 4 Related Art
FIG. 4 illustrates a section across line I—I in FIG. 3.
Figure 5:
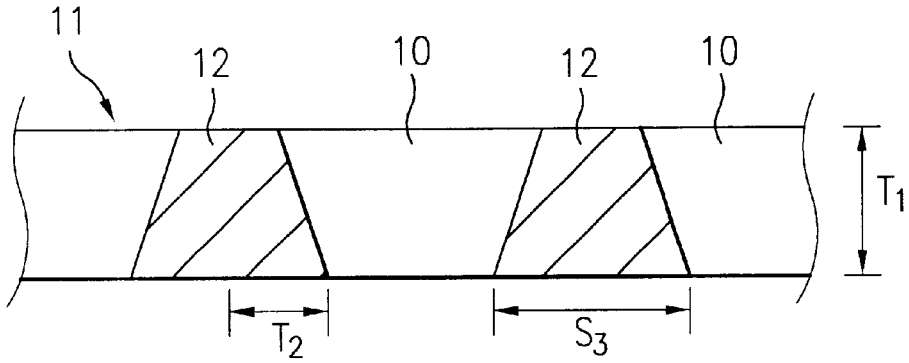
FIG. 5 Related Art
FIG. 5 illustrates a section of a key part of a related art thick mask.
Figure 6:
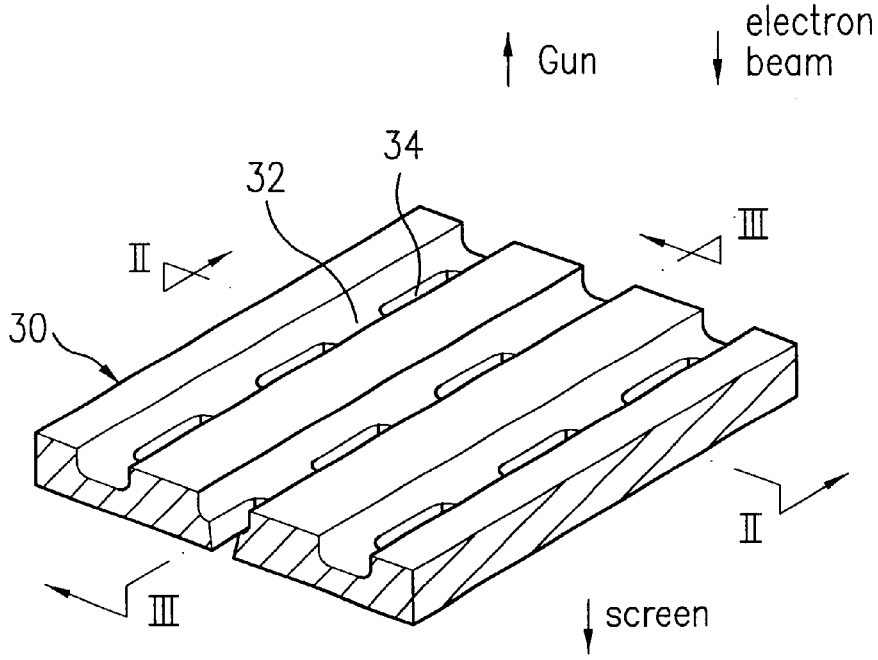
FIG. 6 illustrates a perspective view of a key part of a mask in accordance with a preferred embodiment of the present invention; and, FIG. 7 illustrates a section across line II—II in FIG. 6; and, FIG. 8 illustrates a section across line III—III in FIG. 6.

Reference will now be made in detail to the preferred embodiments of the present invention, examples of which are illustrated in the accompanying drawings. The preferred embodiment of the present invention will be explained with reference to FIGS. 6~8. The mask has numerous electron beam pass through holes of a fixed pattern formed therein for selective pass through of the electron beams 9, with bridges connected to non-hole portions between the beam pass through holes in a width direction. As shown in FIG. 6, the mask 30 of the present invention is designed to have approximately 80 $\mu$m thickness, and an allowable maximum range of tension thickness for solving problems in the related art caused by insufficient thickness.

Figure 7:
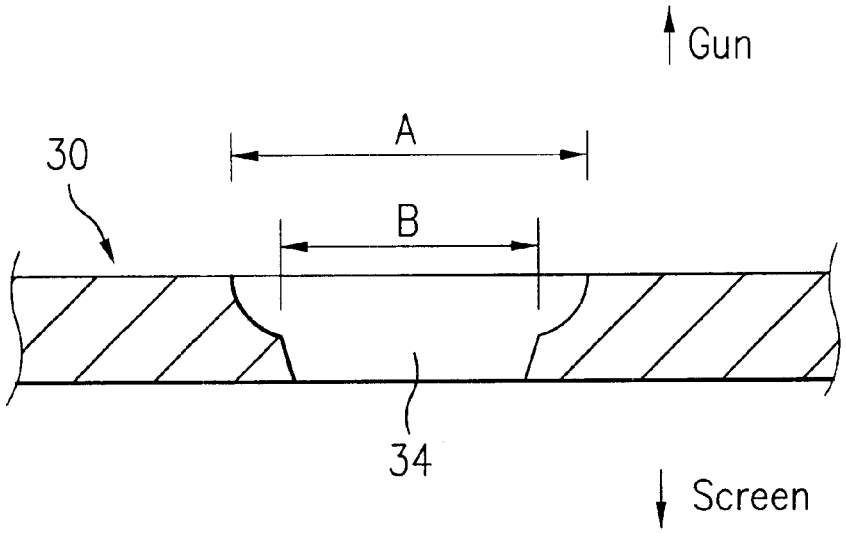
Figure 8:
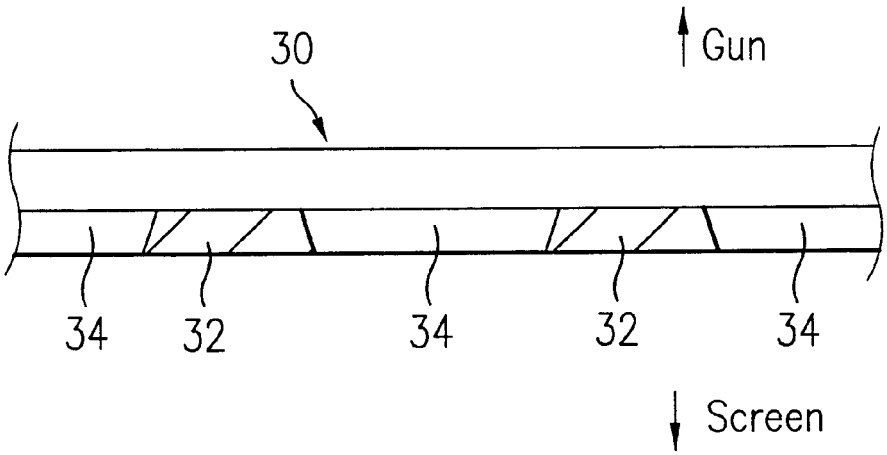

Moreover, the drop in actual transmissivity caused by the increased thickness is solved as follows. A thickness of the mask 30 in the vicinity of the bridges 32, or in the vicinity of the beam pass through holes 34 inclusive of the bridges 32, is formed thinner relative to a thickness of portions of the mask 30 excluding the portions in the vicinity of the bridges 32, or in the vicinity of the beam pass through holes 34 inclusive of the bridges 32, for improving the beam transmissivity. Considering that the beam transmissivity decreases as the thicknesses of the beam pass through holes 34 and the bridges become the thicker, and increases as the thicknesses of the beam pass through holes 34 and the bridges become the thinner, the mask 30 of the present invention can have an increased beam transmissivity by reducing the thicknesses of the beam pass through holes 34 and the bridges 32. As shown in FIG. 7, a width 'A' of a thin portion in the mask 30 is designed to be larger than a width 'B' of the beam pass through hole, but smaller than 2×the width 'B' of the beam pass through hole($B \leqq A \leqq 2B$). Because, if the width 'A' of the thin portion is smaller than the width 'B' of the beam pass through hole, an effect of the beam transmissivity enhancement is dropped, and opposite to this, if the width 'A' of the thin portion is greater than the width 2×'B' of the beam pass through hole, a tensile strength of the mask 30 is dropped. And, as shown in FIG. 8, a thickness ratio of the thicker portion to the thinner portion is required to have a relation of the thicker portion×⅛≦thin portion≦thick portion×⅝, because, if the thin portion is thinner than (the thick portion×⅛), the tensile strength of the mask is weak, and, opposite to this, if the thinner portion is thicker than (the thick portion×⅝), the beam transmissivity is dropped as the thickness increases. And, for forming the thickness of the mask 30 in the vicinity of the bridges 32, or in the vicinity of the beam pass through holes 34 inclusive of the bridges 32, thinner, either side, or both sides, of the mask 30 facing the electron gun 13 and/or the panel 1 in the vicinity of the bridges 32, or in the vicinity of the beam pass through holes 34 inclusive of the bridges 32, may be recessed. In view of advantages in fabrication, it is preferable that the side facing the electron gun 13 is recessed. The recess may be done by a half-etching process mostly used in thin film etching.

Thus, the mask in a color cathode ray tube of the present invention can reduce an amount of the electron beam cut off by the bridge 32 as areas of the bridges 32 with respect to an incident direction of the electron beams can be reduced by forming thicknesses of the mask 30 in the vicinity of the bridges 32, or in the vicinity of the beam pass through holes 34 inclusive of the bridges 32, thinner by half etching. Accordingly, vibration of the mask 30 can be attenuated as the mask 30 is kept thicker, and luminance of the screen can be enhanced as an amount of transmission of the electron beams 9 through the beam pass through holes 34 can be increased in comparison to the mask with an increased fixed thickness.

As has been explained, the mask in a color cathode ray tube of the present invention has the following advantages.

The thick mask of the present invention can prevent, not only deformation of the mask during fabrication, but also howling because the amount of vibration occurring due to external impact is not great enough to cause problems even if the mask is fitted to the cathode ray tube.

The thick mask of the present invention permits washing to prevent clogging of the beam pass through holes by foreign matter since there is no fear of deformation, contrary to the thin mask in the related art.

A transmissivity almost similar to a related art mask with a 25 $\mu$m thickness can be maintained because an area around the beam pass through hole is formed thin by the half-etching process even if the overall thickness is great.

The reduction of the requirement for rolling from three times to one or two times for making a flat mask simplifies the fabrication process, and improves the supply speed of a raw materials as there is no possibility of deformation during transportation.

It will be apparent to those skilled in the art that various modifications and variations can be made in the mask in a color cathode ray tube of the present invention without departing from the spirit or scope of the invention. Thus, it is intended that the present invention cover the modifications and variations of this invention provided they come within the scope of the appended claims and their equivalents.

What is claimed is:

1. A mask in a color cathode ray tube, comprising electron beam pass through holes with bridges connected to non-hole portions between the beam pass through holes in a width direction, wherein a side of said mask having a substantially even surface faces a screen of said color cathode ray tube, and an opposite side of said mask having an uneven surface comprising both recessed portions and portions that are raised relative to said recessed portions faces an electron gun, and a thickness of a bridge of the mask facing the electron gun is formed thinner than other portions of the mask.

2. A mask as claimed in claim 1, wherein a relation of a thicker portion to a thinner portion of the mask is the thicker portion×⅛≦thinner portion≦thicker portion×⅝.

3. A mask as claimed in claim 1, wherein a relation of a width 'A' of a thinner portion of the mask to a width 'B' of the beam pass through hole is $B \leqq A \leqq 2B$.

4. A mask as claimed in claim 1, wherein a thickness of a portion in the vicinity of the beam pass through hole inclusive of the bridge is formed thinner than other portions.

5. A mask as claimed in claim 4, wherein the bridge or a portion in the vicinity of the beam pass through hole inclusive of the bridge is recessed by etching.

6. A mask as claimed in claim 4, wherein a relation of a thicker portion to a thinner portion of the mask is the thicker portion×⅛≦thinner portion≦thicker portion×⅝.

7. A mask as claimed in claim 4, wherein a relation of a width 'A' of a thinner portion of the mask to a width 'B' of the beam pass through hole is $B \leqq A \leqq 2B$.

8. A mask as claimed in claim 1, wherein the mask has a thickness in a range of 25~80 $\mu$m.

9. A mask as claimed in claim 1, wherein the thickness of the bridge of the mask facing an electron gun is approximately 10 micrometers.

10. A mask as claimed in claim 4, wherein the thickness of the bridge of the mask facing an electron gun is approximately 60 micrometers.

11. A mask in a color cathode ray tube, comprising electron beam pass through holes with bridges connected to non-hole portions between the beam pass through holes in a width direction, wherein:

a side of said mask having a substantially even surface faces a screen of said color cathode ray tube, and an opposite side of said mask having an uneven surface comprising both recessed portions and portions that are raised relative to said recessed portions faces an electron gun;

a thickness of the bridge of the mask facing the electron gun is formed thinner than other portions of the mask;

a thickness of a portion in the vicinity of the beam pass through hole inclusive of a bridge is formed thinner than other portions; and the bridge or a portion in the vicinity of the beam pass through hole inclusive of the bridge is recessed by etching.

* * * * *